US009651219B2

(12) United States Patent
Dassanayake et al.

(10) Patent No.: US 9,651,219 B2
(45) Date of Patent: May 16, 2017

(54) LIGHT BULB ASSEMBLY HAVING INTERNAL REDIRECTION ELEMENT FOR IMPROVED DIRECTIONAL LIGHT DISTRIBUTION

(71) Applicant: eLUMIGEN, LLC, Auburn Hills, MI (US)

(72) Inventors: Mahendra Dassanayake, Bloomfield Hills, MI (US); Brian Petku, Clarkston, MI (US)

(73) Assignee: eLumigen LLC, Auburn Hills, MI (US)

( * ) Notice: Subject to any disclaimer, the term of this patent is extended or adjusted under 35 U.S.C. 154(b) by 0 days.

(21) Appl. No.: 14/821,864

(22) Filed: Aug. 10, 2015

(65) Prior Publication Data

US 2016/0053966 A1 Feb. 25, 2016

Related U.S. Application Data

(60) Provisional application No. 62/039,695, filed on Aug. 20, 2014.

(51) Int. Cl.
*F21V 7/00* (2006.01)
*F21V 7/04* (2006.01)
(Continued)

(52) U.S. Cl.
CPC ..... *F21V 7/0016* (2013.01); *F21K 9/23* (2016.08); *F21K 9/232* (2016.08); *F21K 9/65* (2016.08);
(Continued)

(58) Field of Classification Search
CPC ..... F21V 7/0016; F21V 7/0008; F21V 7/041; F21V 7/045; F21V 7/06; F21V 7/07;
(Continued)

(56) References Cited

U.S. PATENT DOCUMENTS 4,727,289 A 2/1988 Uchida
5,132,875 A 7/1992 Plesinger
(Continued)

FOREIGN PATENT DOCUMENTS

CN 2444117 Y 8/2001
DE 1 566 447 4/1980
(Continued)

OTHER PUBLICATIONS

International Search Report for Application No. PCT/US2015/045879, ISA/EP Rijswijk, NL mailed Oct. 7, 2015.

*Primary Examiner* — Laura Tso
(74) *Attorney, Agent, or Firm* — Harness, Dickey & Pierce, PLC

(57) ABSTRACT

A light assembly includes a cover having an upper portion and a redirection portion. The cover has a longitudinal axis and a housing that is coupled to the cover. A lamp base is coupled to the housing. A circuit board is disposed within the housing. The circuit board has a plurality of light sources thereon. An internal redirection element is coupled to the circuit board and has a curvilinear shaped surface for reflecting a first portion of light from the plurality of light sources through the redirection portion of the cover and transmitting a second portion of light therethrough.

15 Claims, 12 Drawing Sheets

(51) Int. Cl.

| | |
|---|---|
| ***F21V 7/06*** | (2006.01) |
| ***F21V 7/07*** | (2006.01) |
| ***F21V 7/08*** | (2006.01) |
| ***F21V 14/04*** | (2006.01) |
| ***F21K 9/23*** | (2016.01) |
| ***F21K 9/232*** | (2016.01) |
| ***F21K 9/65*** | (2016.01) |
| *F21Y 101/00* | (2016.01) |
| *F21Y 103/33* | (2016.01) |

(52) U.S. Cl.
CPC ..... *F21V 7/0008* (2013.01); *F21V 7/041* (2013.01); *F21V 7/045* (2013.01); *F21V 7/06* (2013.01); *F21V 7/07* (2013.01); *F21V 7/08* (2013.01); *F21V 14/04* (2013.01); *F21Y 2101/00* (2013.01); *F21Y 2103/33* (2016.08)

(58) Field of Classification Search
CPC ... F21V 7/08; F21V 14/04; F21K 9/23; F21K 9/232; F21K 9/65; F21Y 2103/33
USPC ..... 362/296.06, 650, 235, 249.02, 247, 244
See application file for complete search history.

(56) References Cited

U.S. PATENT DOCUMENTS

| | | | | |
|---|---|---|---|---|
| 5,654,587 | A | 8/1997 | Schneider et al. | |
| 6,019,493 | A | 2/2000 | Kuo et al. | |
| 6,045,240 | A | 4/2000 | Hochstein | |
| 6,149,283 | A | 11/2000 | Conway et al. | |
| 6,183,100 | B1 * | 2/2001 | Suckow | B60Q 1/2611 257/E25.028 |
| 6,538,892 | B2 | 3/2003 | Smalc | |
| 6,659,632 | B2 | 12/2003 | Chen | |
| 6,688,753 | B2 | 2/2004 | Calon et al. | |
| 6,767,111 | B1 | 7/2004 | Lai | |
| D494,687 | S | 8/2004 | Matsui et al. | |
| 6,820,998 | B2 | 11/2004 | Chen | |
| 6,827,475 | B2 | 12/2004 | Vetorino et al. | |
| 6,840,654 | B2 | 1/2005 | Guerrieri et al. | |
| 6,864,513 | B2 | 3/2005 | Lin et al. | |
| 6,948,829 | B2 | 9/2005 | Verdes et al. | |
| 6,965,205 | B2 | 11/2005 | Piepgras et al. | |
| 6,982,518 | B2 | 1/2006 | Chou et al. | |
| 7,038,399 | B2 | 5/2006 | Lys et al. | |
| 7,068,512 | B2 | 6/2006 | Lee et al. | |
| 7,125,160 | B2 | 10/2006 | Wong et al. | |
| D531,740 | S | 11/2006 | Maxik | |
| D532,532 | S | 11/2006 | Maxik | |
| 7,160,012 | B2 | 1/2007 | Hilscher et al. | |
| 7,161,311 | B2 | 1/2007 | Mueller et al. | |
| 7,181,378 | B2 | 2/2007 | Benitez et al. | |
| D538,950 | S | 3/2007 | Maxik | |
| D538,952 | S | 3/2007 | Maxik et al. | |
| 7,226,189 | B2 | 6/2007 | Lee et al. | |
| 7,246,919 | B2 | 7/2007 | Porchia et al. | |
| 7,253,447 | B2 | 8/2007 | Oishi et al. | |
| D553,266 | S | 10/2007 | Maxik | |
| 7,319,293 | B2 | 1/2008 | Maxik | |
| 7,344,279 | B2 | 3/2008 | Mueller et al. | |
| D566,309 | S | 4/2008 | Kornfeld et al. | |
| D566,323 | S | 4/2008 | Piepgras et al. | |
| 7,350,936 | B2 | 4/2008 | Ducharme et al. | |
| 7,352,138 | B2 | 4/2008 | Lys et al. | |
| 7,358,679 | B2 | 4/2008 | Lys et al. | |
| 7,367,692 | B2 | 5/2008 | Maxik | |
| 7,375,476 | B2 | 5/2008 | Walter et al. | |
| 7,396,142 | B2 | 7/2008 | Laizure, Jr. et al. | |
| 7,401,948 | B2 | 7/2008 | Chinniah et al. | |
| 7,445,340 | B2 | 11/2008 | Conner et al. | |
| D584,838 | S | 1/2009 | To et al. | |
| 7,482,632 | B2 | 1/2009 | Lu et al. | |
| 7,497,596 | B2 | 3/2009 | Ge | |
| 7,520,634 | B2 | 4/2009 | Ducharme et al. | |
| 7,521,875 | B2 | 4/2009 | Maxik | |
| 7,524,089 | B2 | 4/2009 | Park | |
| 7,527,397 | B2 | 5/2009 | Li | |
| 7,540,616 | B2 | 6/2009 | Conner | |
| 7,547,894 | B2 | 6/2009 | Agrawal et al. | |
| 7,604,378 | B2 | 10/2009 | Wolf et al. | |
| 7,607,802 | B2 | 10/2009 | Kang et al. | |
| D604,434 | S | 11/2009 | Wada et al. | |
| 8,192,057 | B2 | 6/2012 | Dassanayake et al. | |
| 8,277,082 | B2 | 10/2012 | Dassanayake et al. | |
| 8,419,218 | B2 | 4/2013 | Dassanayake et al. | |
| 8,449,137 | B2 | 5/2013 | Dassanayake et al. | |
| 8,573,806 | B1 * | 11/2013 | Moon | F21V 7/06 362/249.02 |
| 8,820,962 | B2 * | 9/2014 | Kang | F21V 3/00 362/236 |
| 2003/0021117 | A1 | 1/2003 | Chan | |
| 2005/0094401 | A1 | 5/2005 | Magarill | |
| 2005/0173675 | A1 | 8/2005 | Schmidt et al. | |
| 2006/0098440 | A1 | 5/2006 | Allen | |
| 2006/0238136 | A1 | 10/2006 | Johnson, III et al. | |
| 2006/0262544 | A1 | 11/2006 | Piepgras et al. | |
| 2007/0139938 | A1 | 6/2007 | Petroski et al. | |
| 2007/0165408 | A1 | 7/2007 | Li | |
| 2008/0013334 | A1 | 1/2008 | Lu et al. | |
| 2008/0093998 | A1 | 4/2008 | Dennery et al. | |
| 2008/0106893 | A1 | 5/2008 | Johnson et al. | |
| 2008/0232119 | A1 | 9/2008 | Ribarich | |
| 2008/0295522 | A1 | 12/2008 | Hubbell et al. | |
| 2008/0310158 | A1 | 12/2008 | Harbers et al. | |
| 2009/0001399 | A1 | 1/2009 | Diana et al. | |
| 2009/0059559 | A1 | 3/2009 | Pabst et al. | |
| 2009/0302237 | A1 | 12/2009 | Bortz et al. | |
| 2010/0010701 | A1 | 1/2010 | Gärtner | |
| 2010/0020538 | A1 | 1/2010 | Schulz et al. | |
| 2010/0027281 | A1 | 2/2010 | Waters et al. | |
| 2010/0103666 | A1 | 4/2010 | Chang et al. | |
| 2010/0103669 | A1 | 4/2010 | Yang et al. | |
| 2010/0103671 | A1 | 4/2010 | Zheng | |
| 2010/0110683 | A1 | 5/2010 | Fang et al. | |
| 2010/0110687 | A1 | 5/2010 | Zheng | |
| 2010/0118537 | A1 | 5/2010 | Shin | |
| 2010/0135012 | A1 | 6/2010 | Lee | |
| 2011/0254441 | A1 | 10/2011 | Dassanayake et al. | |
| 2013/0083526 | A1 * | 4/2013 | Kadoriku | B29C 45/0055 362/235 |
| 2013/0128570 | A1 | 5/2013 | Jiang et al. | |
| 2013/0229801 | A1 * | 9/2013 | Breidenassel | F21V 3/02 362/235 |
| 2013/0235582 | A1 * | 9/2013 | Breidenassel | F21V 7/04 362/241 |
| 2013/0335966 | A1 * | 12/2013 | Yokota | F21K 9/52 362/235 |
| 2015/0103512 | A1 | 4/2015 | Dassanayake et al. | |
| 2015/0198315 | A1 | 7/2015 | Dassanayake | |

FOREIGN PATENT DOCUMENTS

| | | | |
|---|---|---|---|
| DE | 103 44 547 | A1 | 8/2005 |
| DE | 102012211936 | A1 | 1/2014 |
| EP | 1 411 290 | A1 | 4/2004 |
| FR | 984.607 | | 7/1951 |
| JP | 2003-31005 | | 1/2003 |
| JP | 2006-156187 | | 6/2006 |
| WO | WO 2004/100213 | | 11/2004 |
| WO | WO 2007/067513 | | 6/2007 |
| WO | WO 2009/063655 | | 5/2009 |
| WO | 2012140812 | A1 | 10/2012 |
| WO | 2014050008 | A1 | 4/2014 |

* cited by examiner

LIGHT BULB ASSEMBLY HAVING INTERNAL REDIRECTION ELEMENT FOR IMPROVED DIRECTIONAL LIGHT DISTRIBUTION

INCORPORATION BY REFERENCE

This application incorporates the entire disclosures of the following applications by reference: U.S. Provisional Application Nos. 61/220,019, filed on Jun. 24, 2009 and 61/265,149, filed Nov. 30, 2009, U.S. application Ser. No. 12/817,807 filed on Jun. 17, 2010, U.S. application Ser. No. 13/492,177, filed on Jun. 8, 2012 and U.S. Provisional Application No. 62/039,695 filed on Aug. 20, 2014.

TECHNICAL FIELD

The present disclosure relates generally to lighting using solid state light sources such as light-emitting diodes or lasers and, more specifically, to lighting devices for various applications that use conic sections and various structural relationships to provide an energy-efficient long-lasting life source.

BACKGROUND

This section provides background information related to the present disclosure which is not necessarily prior art.

Providing alternative light sources is an important goal to reduce energy consumption. Alternatives to incandescent bulbs include compact fluorescent bulbs and light-emitting diode (LED) light bulbs. The compact fluorescent light bulbs use significantly less power for illumination. However, the materials used in compact fluorescent bulbs are not environmentally friendly.

Various configurations are known for light-emitting diode lights. Light-emitting diode lights last longer and have less environmental impact than compact fluorescent bulbs. Light-emitting diode lights use less power than compact fluorescent bulbs. However, many compact fluorescent bulbs and light-emitting diode lights do not have the same light spectrum as incandescent bulbs. They are also relatively expensive. In order to achieve maximum life from a light-emitting diode, heat must be removed from around the light-emitting diode. In many known configurations, light-emitting diode lights are subject to premature failure due to heat and light output deterrents with increased temperature.

Energy Star has purposed luminous intensity distribution requirements for omni-directional lamps. The luminous intensity is measured within each vertical plane at a five degree vertical angle increment from 0° to 135° degrees. This is illustrated in FIG. 1. Ninety percent of the measured intensity values may vary by no more than 25% from all the average of the measure values in all planes. The measurements repeated in vertical planes about the lamp polar axis in maximum increments of 22.5° from 0° through 180°. Meeting the requirements particularly in the range from 180° to 135° is difficult with light emitting diode based lamps due to the inherent directionality of the light output of a light emitting diode.

SUMMARY

This section provides a general summary of the disclosure, and is not a comprehensive disclosure of its full scope or all of its features.

The present disclosure provides a lighting assembly that is used for generating light and providing a long-lasting and thus cost-effective unit. The examples provided in the present disclosure improve the distribution of light around and through the light assembly.

In one aspect of the disclosure, a lighting assembly includes a cover having an upper portion and a redirection portion. The cover has a longitudinal axis and a housing that is coupled to the cover. A lamp base is coupled to the housing. A circuit board is disposed within the housing. The circuit board has a plurality of light sources thereon. An internal redirection element is coupled to the circuit board and has a curvilinear shaped surface for reflecting a first portion of light from the plurality of light sources through the redirection portion of the cover and transmitting a second portion of light therethrough.

DRAWINGS

The drawings described herein are for illustrative purposes only of selected examples and not all possible implementations, and are not intended to limit the scope of the present disclosure.

Corresponding reference numerals indicate corresponding parts throughout the several views of the drawings.

DETAILED DESCRIPTION

Figure 1:
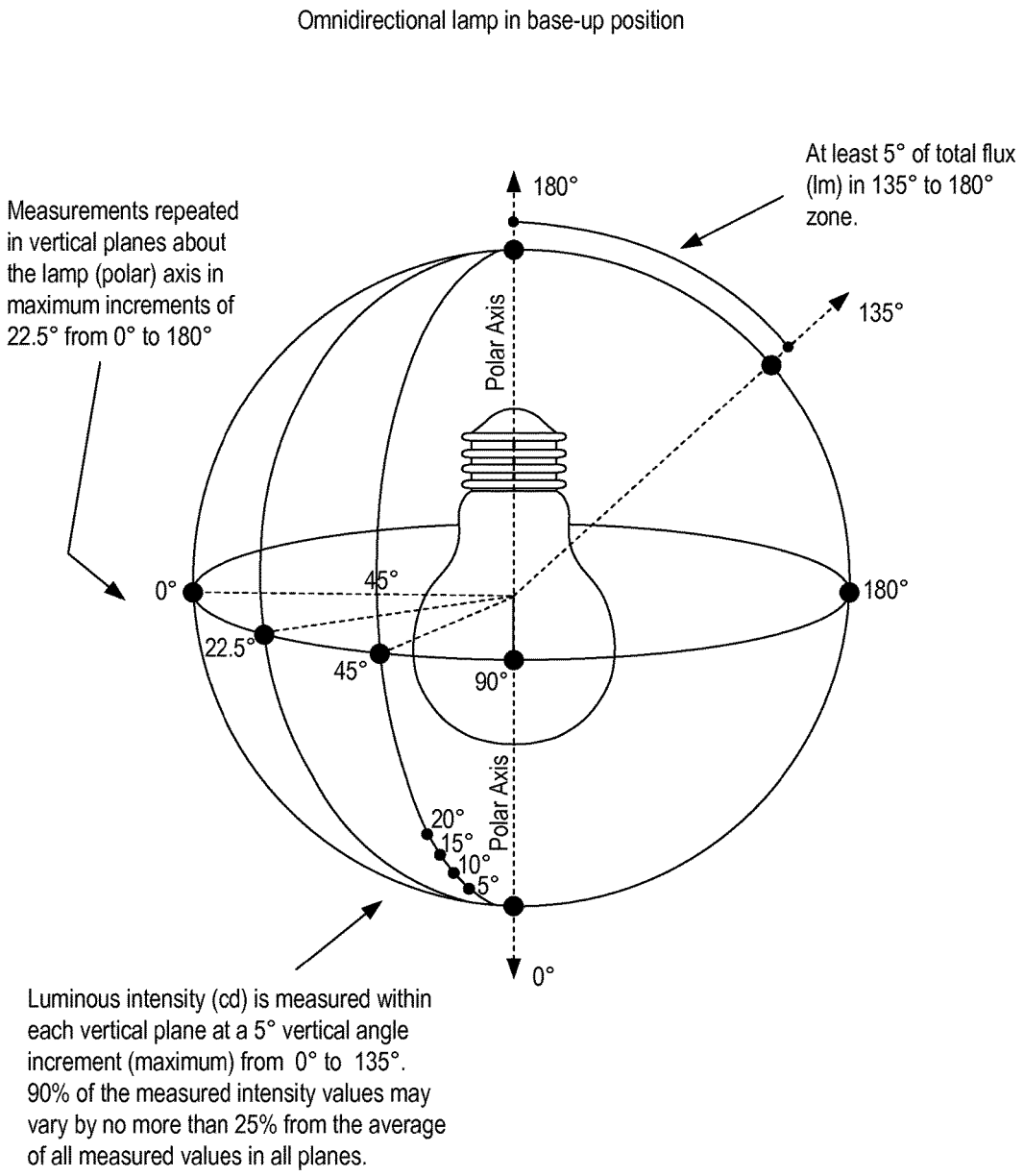
FIG. 1 Prior Art
FIG. 1 is a prior art diagrammatic view of a light distribution requirement from the Energy Star organization.

The following description is merely exemplary in nature and is not intended to limit the present disclosure, application, or uses. For purposes of clarity, the same reference numbers will be used in the drawings to identify similar elements. As used herein, the phrase "at least one of A, B, and C" should be construed to mean a logical (A or B or C), using a non-exclusive logical OR. It should be understood that steps within a method may be executed in different order without altering the principles of the present disclosure.

It should be noted that in the following figures various components may be used interchangeably. For example, several different examples of control circuit boards and light source circuit boards are implemented. As well, various shapes of light redirection elements and heat sinks are also disclosed. Various combinations of heat sinks, control circuit boards, light source circuit boards, and shapes of the light assemblies may be used. Various types of printed traces and materials may also be used interchangeably in the various examples of the light assembly.

In the following figures, a lighting assembly is illustrated having various examples that include solid state light sources such as light-emitting diodes (LEDs) and solid state lasers with various wavelengths. Different numbers of light sources and different numbers of wavelengths may be used to form a desired light output depending upon the ultimate use for the light assembly. The light assembly provides an opto-thermal solution for a light device and uses multiple geometries to achieve the purpose.

The light assemblies described herein may be used for various purposes such as but not limited to household lighting, display lighting, horticultural lighting and aquacultural lighting. The light assemblies may be tuned to output various wavelengths through the use of coating and films depending on the various application.

Referring now to FIG. 2, a cross-section of a light assembly 10 is illustrated. Light assembly 10 may be rotationally symmetric around a longitudinal (or polar) axis 12. The light assembly 10 includes a lamp base 14, a housing 16, and a cover 18. The lamp base or base 14 is used for providing electricity to the bulb. The base 14 may have various shapes depending upon the application. The shapes may include a standard Edison base, or various other types of larger or smaller bases. The base 14 may be various types including screw-in, clip-in or plug-in. The base 14 may be at least partially made from metal for making electrical contact and may also be used for thermal heat conduction and dissipation. The base 14 may also be made from material not limited to ceramic, thermally conductive plastic, plastic with molded circuit connectors, or the like.

The housing 16 may have heat sinking capabilities. In the following example a heat sinking configuration is set forth. The present heat sinking configuration is set forth in U.S. application Ser. No. 12/817,807, filed on Jun. 17, 2010 and Ser. No. 13/492,177 filed on Jun. 8, 2012, the disclosures of which are incorporated by reference herein. However, various configurations and heat sinks may be used. The housing 16 is adjacent to the base 14. The housing 16 may be directly adjacent to the base 14 or have an intermediate portion therebetween. The housing 16 may be formed of a metal or other heat-conductive material such a thermally conductive plastic, plastic or combinations thereof. One example of a suitable metal is aluminum. The housing 16 may be formed in various ways including stamping, extrusion, plastic molding such as over-molding or combinations thereof. Another way of forming the housing 16 includes injected-molded metals such as Zylor®. Thicksoform® molding may also be used. In one constructed example the housing 16 was formed with a first portion 20 and a second portion 22. The first portion 20 is formed of an aluminum material and the second portion 22 is formed at least partially of thermally-conductive plastic. The second portion 22 may also be formed of a portion of thermally-conductive plastic and non-thermally-conductive plastic. Thermally-conductive plastic may be used in higher temperature portions toward the lamp base while non-thermally-conductive less expensive plastic may be used in other portions of the second portion. The formation of the housing 16 will be described further below.

The housing 16 may be formed to provide an air channel 24 formed therein. The air channel 24 has a first cross-sectional area located adjacent to the cover 18 that is wider than the cross-sectional area proximate the lamp base 14. The channels 24 provide convective cooling of the housing 16 and light assembly 10. The tapered cross-sectional area provides a nozzle effect which speeds the velocity of air through the channel 24 as the channel 24 narrows. An inlet 26 to the channel 24 is provided between the second portion 22 and the cover 18. An air outlet 28 provides an outlet from the channel 24. Air from the outlet 28 is travelling at a higher speed than at the inlet 26. Arrows A indicate the direction of input air through the inlet 26 to the channels 24 and arrows B provide the outflow direction of air from the channels 24.

The plurality of channels 24 are spaced around the light assembly 10 to provide distributed cooling.

The housing 16 may define a first volume 29 within the light assembly 10. As will be described below, the first volume 29 may be used to accommodate a control circuit board or other circuitry for controlling the light-emitting diodes or other light sources therein.

The housing 16 may have various outer shapes including a hyperboloidal shape. The housing 16 may also be a free-form shape.

The housing 16 and cover 18 form an enclosure around a substrate or circuit board 30 having light sources 32. The base 14 may also be included as part of the enclosure.

The light assembly 10 includes the substrate or circuit board 30 used for supporting solid state light sources 32. The circuit board 30 may be thermally conductive and may also be made from heat sink material. Solder pads of the light sources may be thermally and/or electrically coupled to radially-oriented copper sectors or circular conductive elements over-molded onto a plastic base to assist in heat conduction. In any of the examples below, the circuit board 30 may be part of the heat sinking process.

The light sources 32 have a high lumen-per-watt output. The light sources 32 may generate the same wavelength of light or may generate different wavelengths of light. The light sources 32 may also be solid state lasers. The solid state lasers may generate collimated light. The light sources 32 may also be light-emitted diodes. A combination of different light sources generating different wavelengths may be used for obtaining a desired spectrum. Examples of suitable wavelengths include ultraviolet or blue (e.g. 450-470 nm). Multiple light sources 32 generating the same wavelengths may also be used. The light sources 32 such as light-emitting diodes generate low-angle light 34 and high-angle light 36. High-angle light 36 is directed out through the cover 18. Three light sources 32 are shown on each half of the light assembly. However the light sources 32 represent three rings of light sources 32. Only one ring may be used. However, two or more rings may be used depending on the desired total Lumen output of the light assembly.

The cover 18 may be a partial spheroid, partial ellipsoid or combinations thereof in shape. The cover 18 may share the longitudinal axis 12. In this example both a spheroidal portion 38 and a partial rotated ellipsoidal portion that may be referred to as a redirection portion 40 are formed into the cover 18. That is, the different cover portions 38, 40 may be monolithic or integrally formed. The cover 18 may be formed of a transparent or translucent material such as glass or plastic. In one example, the cover 18 is formed of polyethylene terephthalate (PET). PET has a crystalline structure that allows heat to be transferred therethrough. Heat may be transferred form the housing 16 into the cover because of the direct contact therebetween. The spherical portion 38 of the cover 18 may be designed to diffuse light and minimize backscattered light trapped within the light assembly 10. The spheroid portion 38 of the cover 18 may be coated with various materials to change the light characteristics such as wavelength or diffusion. An anti-reflective coating may also be applied to the inside of the spheroidal portion 38 of the cover 18. A self-radiating material may also be used which is pumped by the light sources 32. Thus, the light assembly 10 may be formed to have a high color rendering index and color perception in the dark.

Often times in a typical light bulb, the low-angle light is light not directed in a working direction. Low angle light is usually wasted since it is not directed out of the fixture into which the light assembly is coupled.

A portion of the low-angle light 34 may be redirected out of the cover 18 using the redirection portion 40. The redirection portion 40 may be various shapes including a partial spheroid, partial paraboloid, partial ellipsoid, or free-formed shape. The redirection portion 40 may also be shaped to direct the light from the light sources 32 to a central or common point 42 as shown by light ray 34A. The redirection portion 40 may have a coating for wavelength or energy shifting and spectral selection. Coating one or both of the cover 18 and the redirection portion may be performed. Multiple coatings may also be used. The common point 42 may be the center of the spheroid portion of the cover 18.

The redirection portion 40 may have a reflective or partially reflective coating 44 used to increase the reflectivity or change the transmittance thereof. However, certain materials upon forming may not require the coating 44. For example, some plastics, when blow-molded, provide a shiny or reflective surface such as PET. The redirection portion 40 may be formed of the naturally formed reflective surface generated when blow-molding plastic.

The cover 18 may also be formed of partially reflected material. As was described above, a portion of the light rays directed to the redirection portion 40 may also travel through the cover material and directed in a downward direction as illustrated by light ray 34B.

It should be noted that when referring to various conic sections such as an ellipsoid, paraboloid or hyperboloid only a portion or part of the conic section that is rotated around an axis may be used for a particular surface. In a similar manner, portions of a spheroid may be used.

The circuit board 30 may be in direct contact (or indirect contact through an interface layer 50) with the housing 16, and, more specifically to the first portion 20 the housing 16. The housing 16 may include a plurality of fins 52 that extend longitudinally and radially outwardly to form the channels 24. The fins 52 may be spaced apart to allow heat to be dissipated therefrom. As will be described further below, the channels 24 may be formed between an inner wall 54 of the first portion 20, an outer wall 56 of the second portion 22 and the fins 52 that may be formed of a combination of both the first portion 20 and the second portion 22 of the housing 16.

The housing 16 may thus conduct heat away from the light sources 32 of the circuit board for dissipation outside the light assembly. The heat may be dissipated in the housing and the fins 52. Heat may also be transferred into the cover 18 directly from the housing conduction. In this manner heat may be transferred longitudinally by the housing 16 in two directly opposite directions.

The circuit board 30 may also include a receiver 60 for receiving commands from a remote control. The receiver 60 may be various types of receiver including but not limited to an RF receiver or an infrared receiver. Openings 62 may be used for communicating air between the first volume 29 and a second volume 61 within the cover 18. Heated air that is in the cover 18 may be transmitted or communicated into the first volume 29 and through an opening 62 within the first portion 20 of the housing 16 to vent air into the channels 24. The opening 62 will be further described below.

The heated air within the cover 18 may conduct through the cover 18 and circuit board 30 to the housing as well as being communicated through the openings 62.

An internal redirection element 70 is used to redirect or partially transmit both high angle light and low angle light from the light sources 32. The internal redirection elements 70 may be formed of totally reflective material or coated with a totally reflective material. Internal means internal to the light assembly. The internal redirection element 70 may be stamped from metal or formed of a plastic material. The internal redirection element 70 also acts as a heat transfer element. A reflective coating 72 may be provided on the surface of the internal redirection element whether the material is plastic or metal. The coatings may also be reflecting in a portion of the spectrum. The material of the internal direction element may also comprise nanoparticles for wavelength shifting. Coatings may also be used for wave length shifting. A tight mesh material may also be molded within the internal redirection element 70. The mesh material 74 may act as a heat sink to direct heat toward the circuit board and into the heat sinking area below the circuit board. The mesh material 74 may also have wave length shifting details of the formation of the internal redirection element 70 which will be described further below. In general, the internal redirection element 70 is "horn" or bell shaped and is supported by the circuit board. Supporting elements (described below) are not illustrated in FIG. 2A for simplicity.

The material of the element 70 may also transmit light as well as reflect light. Controlling the transmittance and reflectance through choice of materials allows ultimate control of the output and direction of the output of the light assembly. If a material that is not light transmissive is used, holes may be formed through the element 70 to allow light therethrough. The area of the holes may vary depending on the desired light output characteristics. For example, 80% of the light may be reflected while 20% is transmitted through element 70.

Figure 2A:
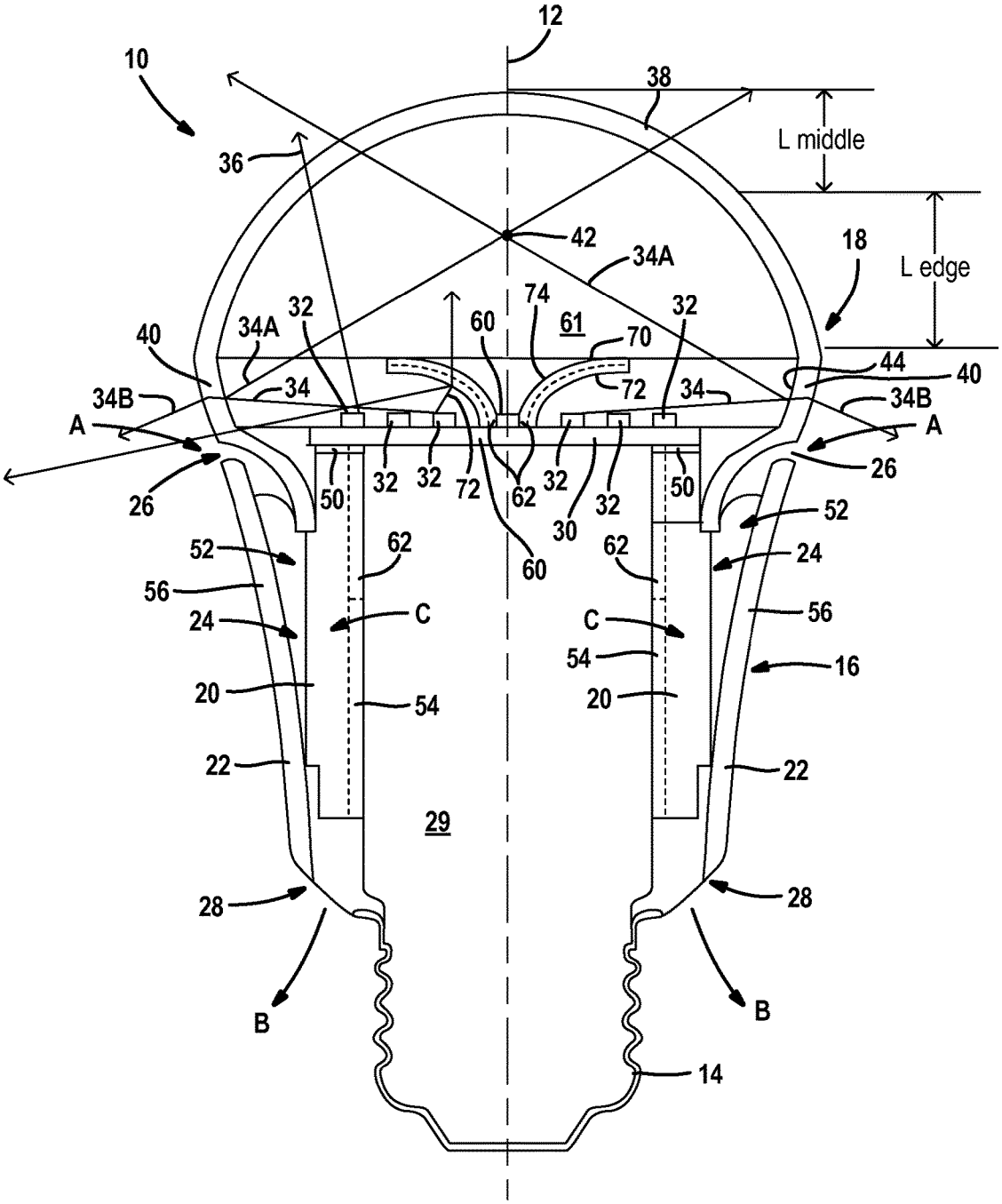
FIG. 2A is a cross-sectional view of a first embodiment of a lighting assembly according to the present disclosure.
Figure 2B:
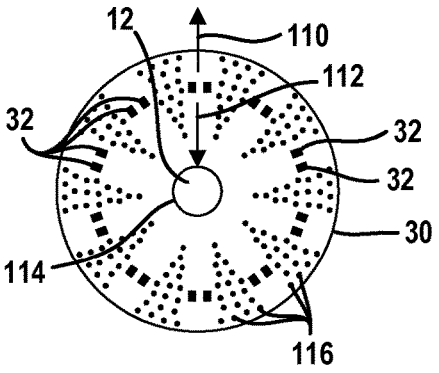
FIG. 2B is a top view of a circuit board according to the present disclosure.

Referring now to FIG. 2B, one example of a circuit board 30 is illustrated. The circuit board 30 includes the plurality of light sources 32 thereon. The circuit board 30 includes a radial outward thermal path 110 and a radially inward thermal path 112. An opening 114 may be provided through the circuit board 30 in place of the openings 62. The opening 114 may remain open to allow air flow circulation within the light assembly 10. The opening 114 may be replaced by more than one opening such as the openings 62. The opening 114 or openings 62 may be sized to receive a wire or wires from a control circuit board to make an electrical connection to the circuit board 30. Such examples will be described below.

Although only six light sources 32 are illustrated in FIG. 2A, more electrical components for driving the light sources may be incorporated onto the circuit board 30. Thermal vias 116 may be provided throughout the circuit board 30 to allow a thermal path to the heat sink. As is illustrated, the thermal vias 116 are generally laid out in a triangular or pie-piece arrangement but do not interfere with the thermal paths 110 and 112. Thermal vias 116 may be directly under the light sources. The light sources 32 are illustrated in a ring 118 around the longitudinal axis 12.

The circuit board 30 may be made out of various materials to form a thermally-conductive substrate. The solder pads of the light sources may be connected to radial-oriented copper sectors or circular conductive elements that are over-molded into a plastic base to conduct heat away from the light sources. By removing the heat from the area of the light sources, the lifetime of the light assembly 10 may be extended. The circuit board 30 may be formed from two-sided FR4 material, heat sink material, or the like. If the board material is electrically conductive, the electrical traces may be formed on a non-conductive layer that is formed on the electrically conductive surface of the circuit board.

Figure 2D:
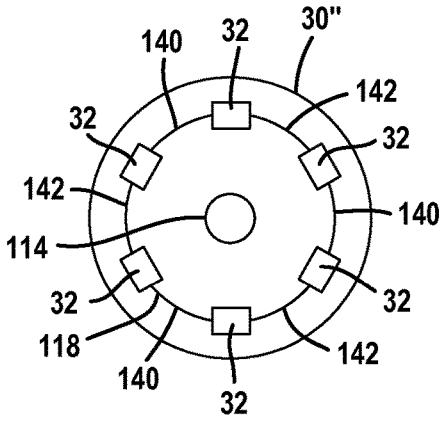
FIG. 2D is a top view of another alternate example.
Figure 2C:
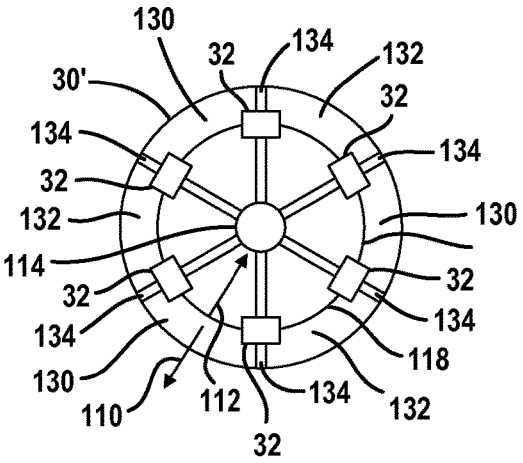
FIG. 2C is a top view of an alternate example.

Referring now to FIG. 2C, an alternative example of the circuit board 30' is illustrated. The circuit board 30' may include a plurality of circuit trace sectors 130 and 132 that are coupled to alternate voltage sources to power the light sources 32. The sectors are separated by a non-conductive gap 134. The light sources 32 may be electrically coupled to alternate sectors 130, 132. The light sources 32 may be soldered or otherwise electrically mounted to the two sectors 130, 132.

Each sector 130, 132 may be disposed on a non-conductive circuit board 30'. As mentioned above, the circuit board 30' may also be formed of a heat sink material. Should the heat sink material be electrically conductive, a non-conductive pad or layer may be placed between the sectors 130, 132 and the circuit board 30'.

The opening 114 is illustrated as a circle. The opening 114 may also be replaced by smaller openings for coupling a wire or wires from a control circuit board thereto. Such an example will be described further below.

Referring now to FIG. 2D, another example of a circuit board 30" is illustrated. The circuit board 30" includes the light sources 32 that are spaced apart by circuit traces 140 and 142. The circuit traces 140 and 142 may have different voltages used for activating or enabling the light sources 32. The circuit traces 140, 142 may be printed on a substrate such as a heat sink substrate. Electrical connections may be made from the control circuit board.

Figure 2E:
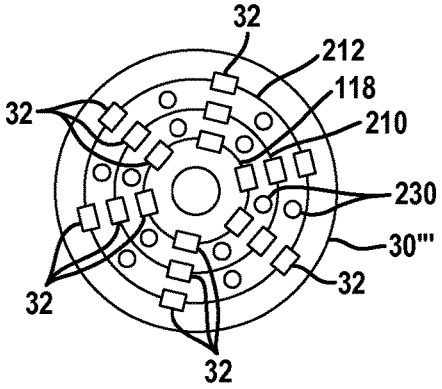
FIG. 2E is a top view of yet another alternate example of the circuit board.

Referring now to FIG. 2E, another example of the circuit board 30'" is set forth. The circuit board 30'" has a first ring 110 of light sources 32 as illustrated in FIGS. 2B-2C. A second ring 210 and a third ring 262 of light sources 32 may also be used depending upon the desired output. For example, the combination of light sources 32 in the first ring may be used to provide an incandescent 40 watt equivalent light assembly. Light sources in the first ring 118 and the second ring 210 may be used to form an incandescent equivalent 60 watt light. Light sources in all three rings 118, 210 and 212 may be used to provide an equivalent 75 or 100 watt light bulb. The circuit board 30'" may also include a plurality of support holes 230 used for supporting the internal redirection element. Although six sets of support holes are illustrated, fewer support holes may be required. The support holes 230 may be used to receive support tabs of supports of the internal redirection element as will be further described below. The support holes 230 may be disposed in pairs or singularly.

Figure 3A:
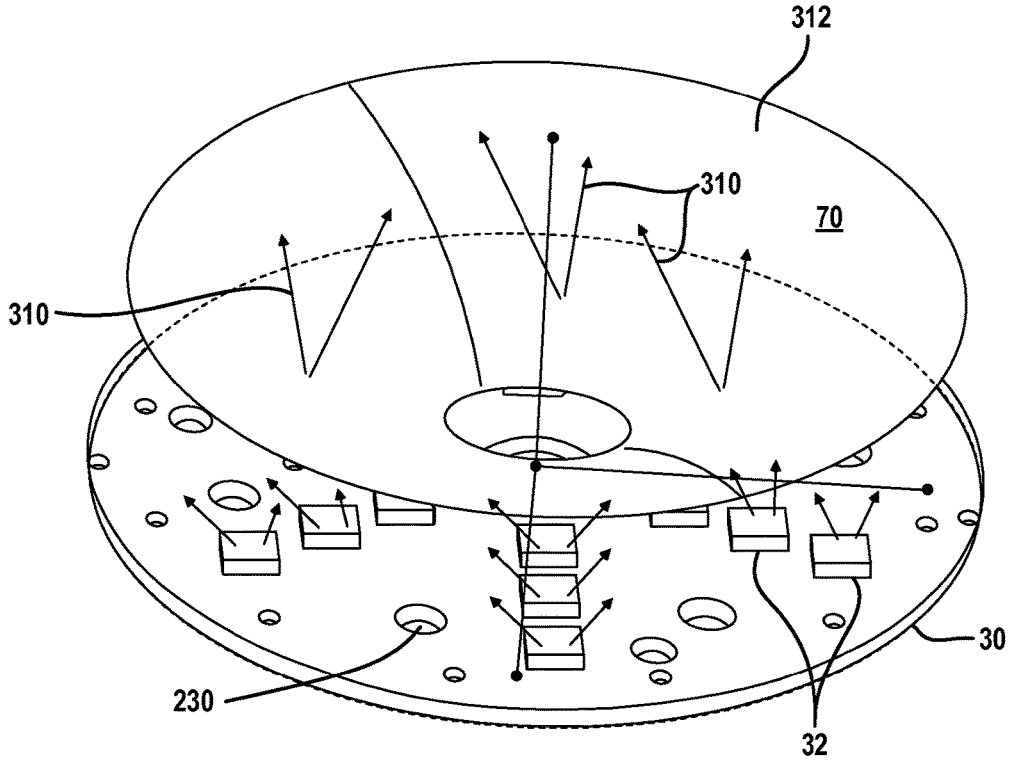
FIG. 3A is a perspective view of an internal redirection element and circuit board according to FIG. 1.

Referring now to FIG. 3A, a perspective view of the internal redirection element 70 relative to the circuit board 30'" is illustrated. In this example, the internal redirection elements 70 are at least partially translucent or transparent. Light rays 310 are from the light sources 32 and are shown at least partially transmitting through the internal redirection element 70. The upper surface 312 of the internal redirection element 70 may also be curved in a horn or bell shape. The support described below is not illustrated filling or coupled to the support holes 230 for simplicity.

Figure 3B:
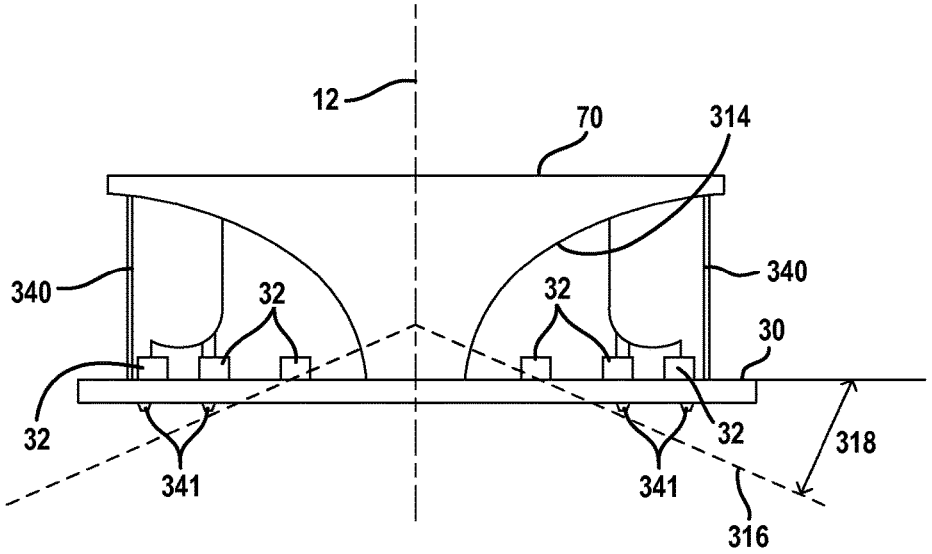
FIG. 3B is a side view of a light redirection element according to FIG. 1.

Referring now to FIG. 3B, the internal redirection element 70 relative to the longitudinal axis 12 is set forth. In this example, the at least partially reflecting or undersurface 314 of the internal redirection element is illustrated. The curve associated with the surface 314 may be various curvilinear shapes. These shapes may include conic sections including, but not limited, to paraboloids, hyperboles, spheres or the like. In the present example, the surface 314 is a paraboloid in cross-section. The paraboloid has an axis 316 that has been shifted about its focal line by an angle 318. In this example, the focal line coincides with the row of LEDs 32 closest to the longitudinal axis of the light assembly axis 12. Light reflecting from the surface 314 will thus reflect parallel to the shifted axis 316 and thus is shifted from the lateral direction of the circuit board 30. The shape of the surface 314 may be formed according to the formulas set forth below:

$$z = \frac{cr^2}{1 + \sqrt{1 - (1 + k)c^2r^2}} + \sum_{i=1}^{n} a_i r^{2i}$$

| Conic Constant | Surface Type |
|---|---|
| k = 0 | spherical |
| k = −1 | Paraboloid |
| k = < −1 | Hyperboloid |
| −1 < k < 0 | Ellipsoid |

c = base curvature at vertex
k = conic constant

Figure 3C:
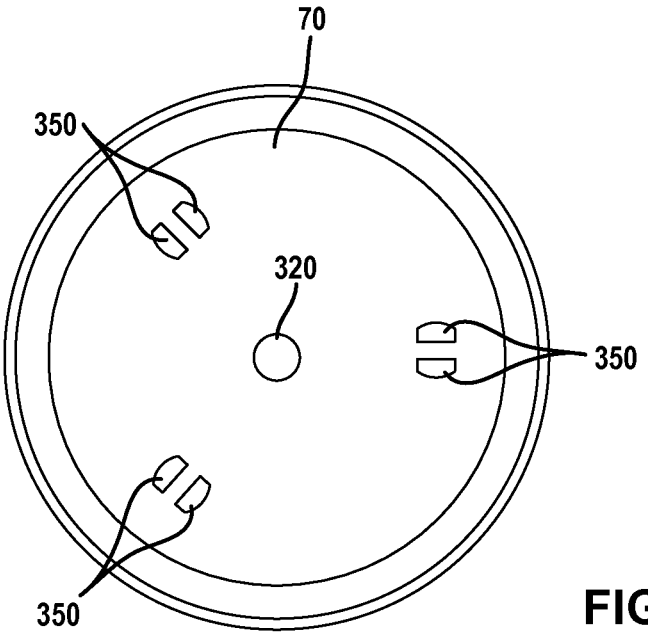
FIG. 3C is a top view of the light redirection element of FIG. 1.

Referring now to FIG. 3C, a top view of the internal redirection element 70 is illustrated. As is illustrated in FIG. 3C, the surface 312 is relatively smooth and curved toward a center opening 320. As described above, there may be a corresponding opening in the circuit board or a receiver chip for receiving remote commands to control dimming or switching of the light sources.

Figure 3D:
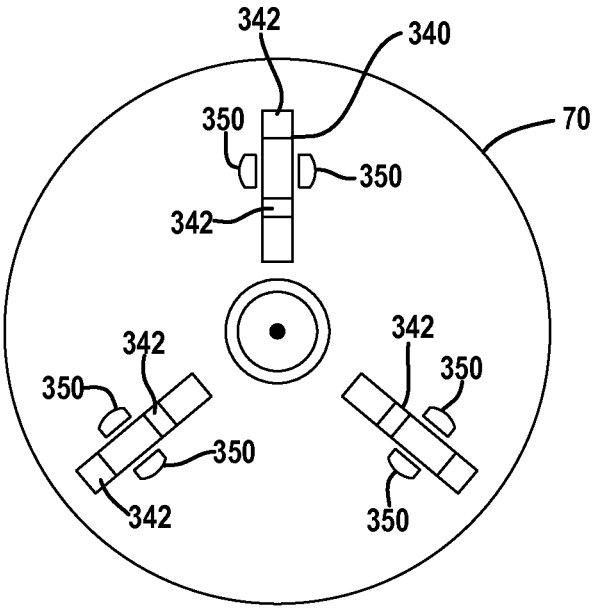
FIG. 3D is a bottom view of the light redirection element of FIG. 1.

Referring now to FIG. 3D, a bottom view of the internal redirection element 70 is set forth. In this example, the supports 340 are illustrated. The supports 340 include tabs 342 that may be received into the support openings 230 of the circuit board 30".

Snaps 341 may be used to secure the redirection element to the circuit board 30.

To facilitate manufacturing, grip holes 350 may be placed through the internal redirection element. The grip holes 350 allow manufacturing equipment to pick and place the internal redirection element relative to the circuit board during the manufacturing process.

Figure 3E:
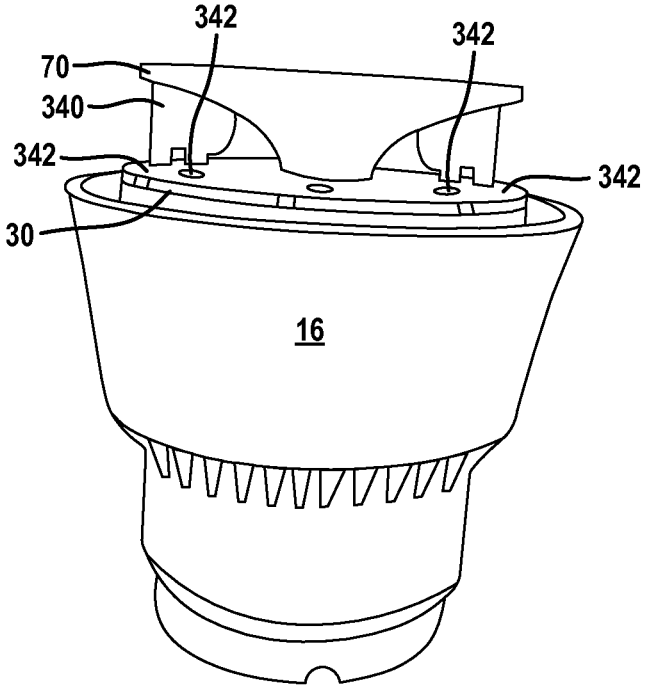
FIG. 3E is a side view of the redirection element relative to the circuit board and housing.

Referring now to FIG. 3E, a side view picture of the internal redirection element 70, the supports 340 and the support tabs 342 relative to the housing 16 is set forth.

Figure 3F:
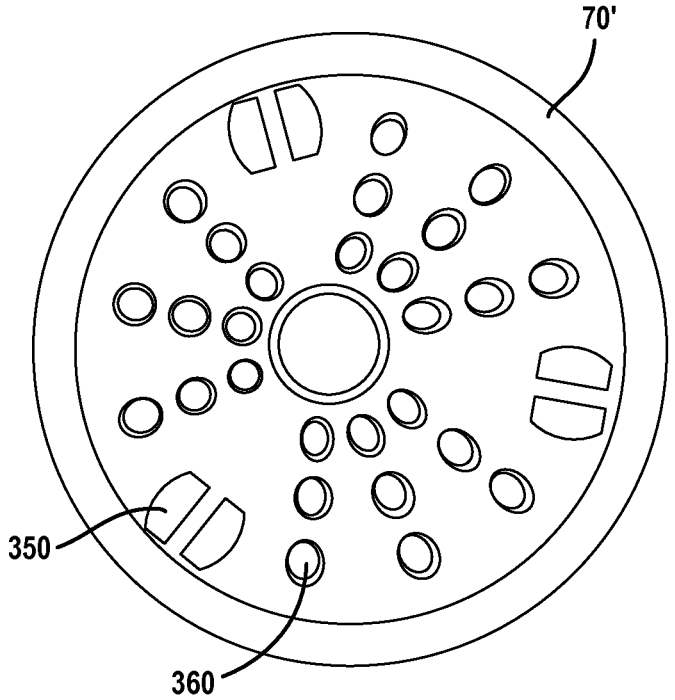
FIG. 3F is an alternative example of a light redirection element having holes or openings therethrough.

Referring now to FIG. 3F, an alternate embodiment of a redirection element 70 is illustrated. Holes 360 may be arranged to transmit light therethrough. Holes 360 may be used when the element 70 is partially transmissive, or non-transmissive, so that a desired amount of light can pass through. In this example, rows of holes are used. The position and number of holes 360 can vary depending on the desired light output characteristics.

Figure 4A:
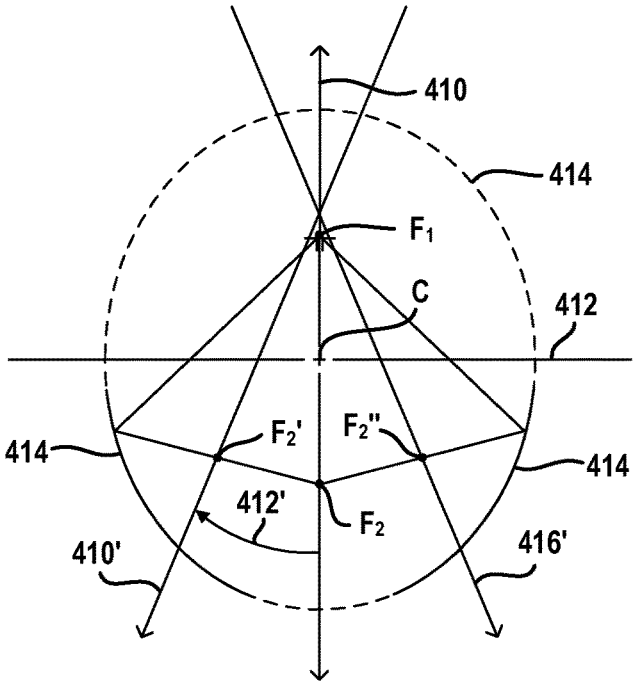
FIG. 4A is a diagrammatic representation for forming the ellipsoid of the cover.

Referring now to FIG. 4A, a method for forming the shifted or offset ellipsoid of the redirection portion 40 illustrated above is set forth. The ellipsoid has two focal points: F1 and F2. The ellipsoid also has a center point C. The major axis 410 of the ellipse 408 is the line that includes F1 and F2. The minor axis 412 is perpendicular to the major axis 410 and intersects the major axis 410 at point C. To form the shifted ellipsoid, the focal points corresponding to the light sources 32 are moved outward from the major axis 410 and are shifted or rotated about the focal point F1. The ellipse 408 is then rotated and a portion of the surface of the formed ellipsoid is used as a reflective surface. The angle 412 may be various angles corresponding to the desired overall geometry of the device. In an ellipse, light generated at point F2 will reflect from a reflector at the outer surface 414 of the ellipse 408 and intersect at point F1.

Figure 4B:
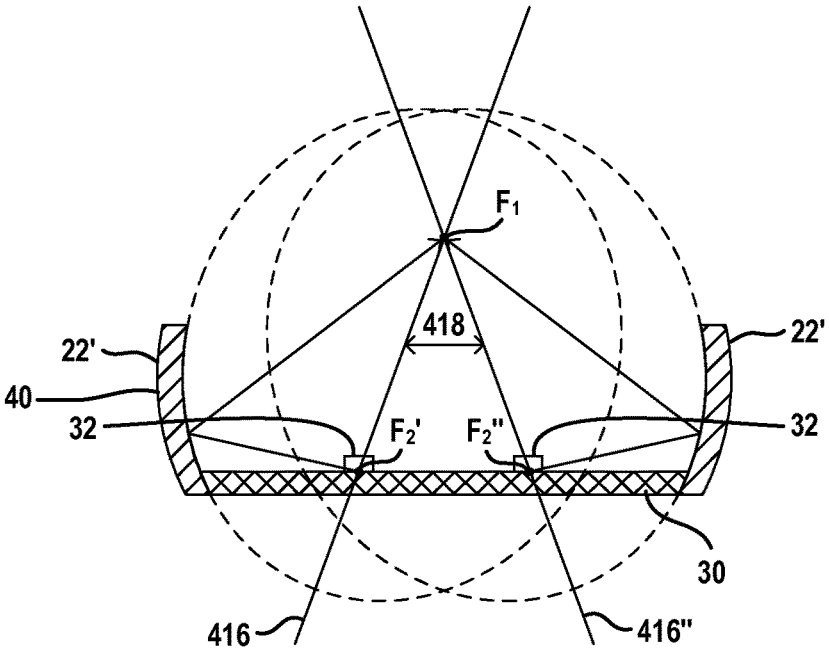
FIG. 4B is a cross-sectional view of the ellipsoid portion of the redirection portion of the cover.

Referring now to FIG. 4B, the shifted or offset ellipsoid will reflect light from the focal points F2' and F2" to intersect on the focal point F1. The focal points F2' and F2" are on a ring of light sources 32 whose low-angle light is reflected from the shifted ellipsoid surface and the light is directed to focal point F1. The construction of the ellipsoid can thus be seen in FIG. 4B since the focal point F2 now becomes the ring that includes F2' and F2". The circuit board 30 may be coupled to or adjacent to the elliptical portion 22' which is the redirection portion 40.

Figure 5A:
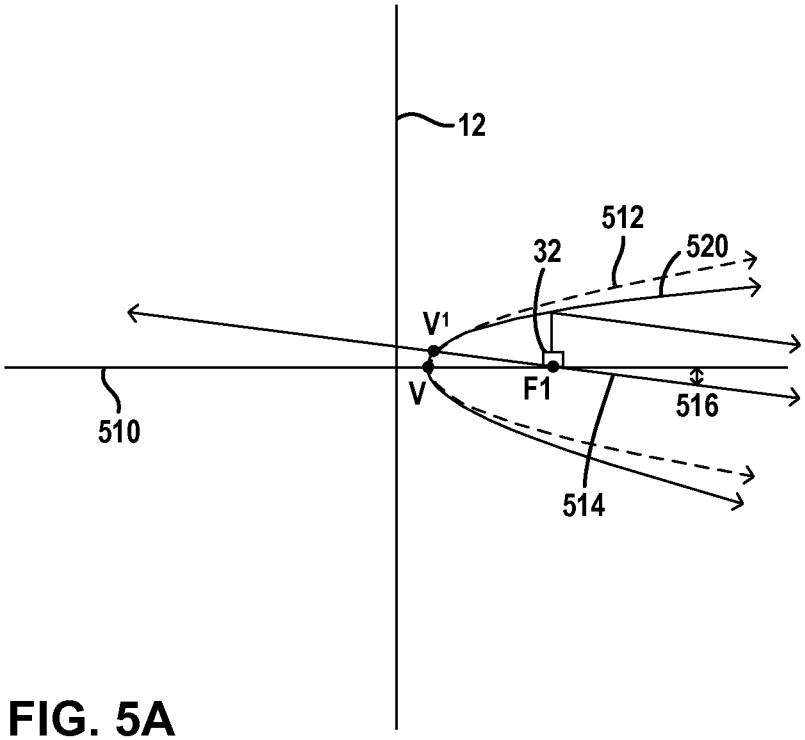
FIG. 5A is a diagrammatic view of an illustration of a first example for forming the internal redirection element.

Referring now to FIG. 5A, a method for forming the surface 314 of the redirection element 70 closest to the light source 32 is set forth. In this example, a parabola is used. As mentioned above, other conic sections may be used such as spheres, ellipses, hyperbolas or the like. The longitudinal or polar axis 12 of the light assembly is also set forth for reference. Longitudinal axis 12 corresponds to the center axis (when assembled) of the internal redirection element 70 and the light assembly 10. A lateral axis 510 is also illustrated. The lateral axis 510 may correspond to the top surface of the circuit board 30 illustrated above. The lateral axis 510 is the lateral axis of the assembly 10. In this example, a parabola 512 is formed about the axis 510. The vertex V of the parabola is shifted away from the longitudinal axis by a predetermined distance. To form the desired surface 314 of the internal direction element 70, the axis 510 of symmetry of the paraboloid is shifted or rotated about (or at) the inner ring (focal ring) of light sources 32 to form the offset axis 514. The vertex V becomes vertex V'. That is, the focus $F_1$ of the parabola coincides with the inner ring of light sources. The shift or offset corresponds to an angle 516 below the circuit board represented by axis 510. A new parabola 520 illustrated in solid lines is formed. The upper half of the parabola 520 is then rotated around the longitudinal axis 12 in a plane parallel with the axis 510. By spinning the parabola 520, the paraboloidal surface 314 may be formed. Rays incident upon the surface 314 originating from or near the focal point F1 (at which place the first ring of light sources is placed) reflect in a direction parallel to the axis 514. This was illustrated in FIG. 2. This configuration allows light to be redirected toward the base direction to meet the standards set forth in FIG. 1. The surface 314 formed by the parabola 520 may thus be referred to as a conic section having an offset axis of symmetry that is rotated about a longitudinal axis of the internal redirection element 70. It should be noted the first ring forms a focal line for the rotated conical surface. Likewise, the redirection portion 40 of the cover shares the same focal ring. In this example, light from the inner ring of light sources angles toward the circuit board. V' is above the plane of the circuit board represented by axis 510.

Figure 5B:
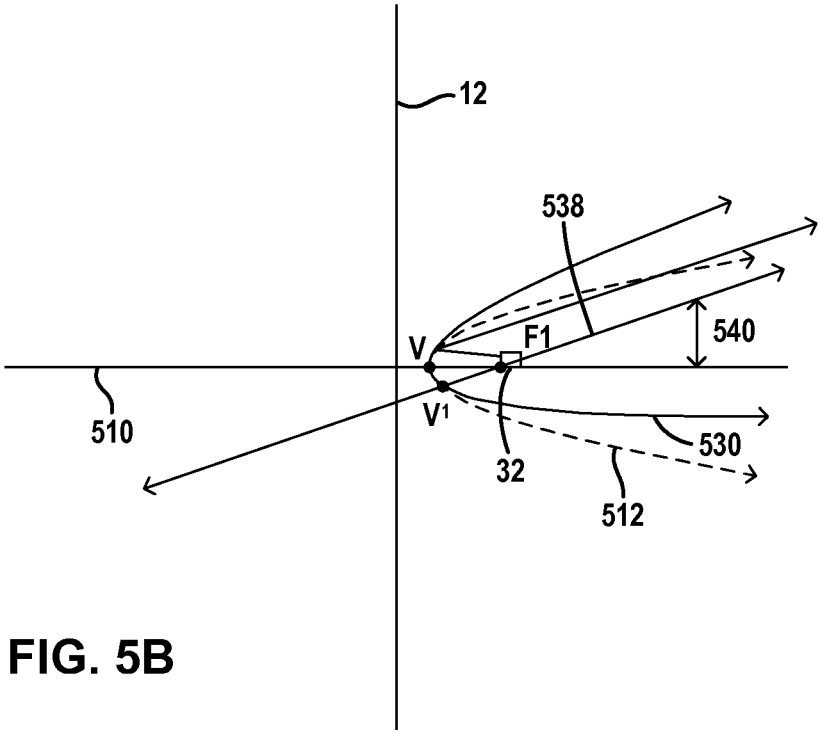
FIG. 5B is a diagrammatic view of an illustration of a second example for forming the internal redirection element

In FIG. 5B, the axis of symmetry of the parabola 530 was shifted to axis 538 above the surface of the circuit board represented by axis 510 by an angle 540. The angle depends on the desired light output. In this example, the light from the inner ring of the light sources angles away from (and above) the circuit board. V' is below the plane of the circuit board represented by axis 510.

Figure 6:
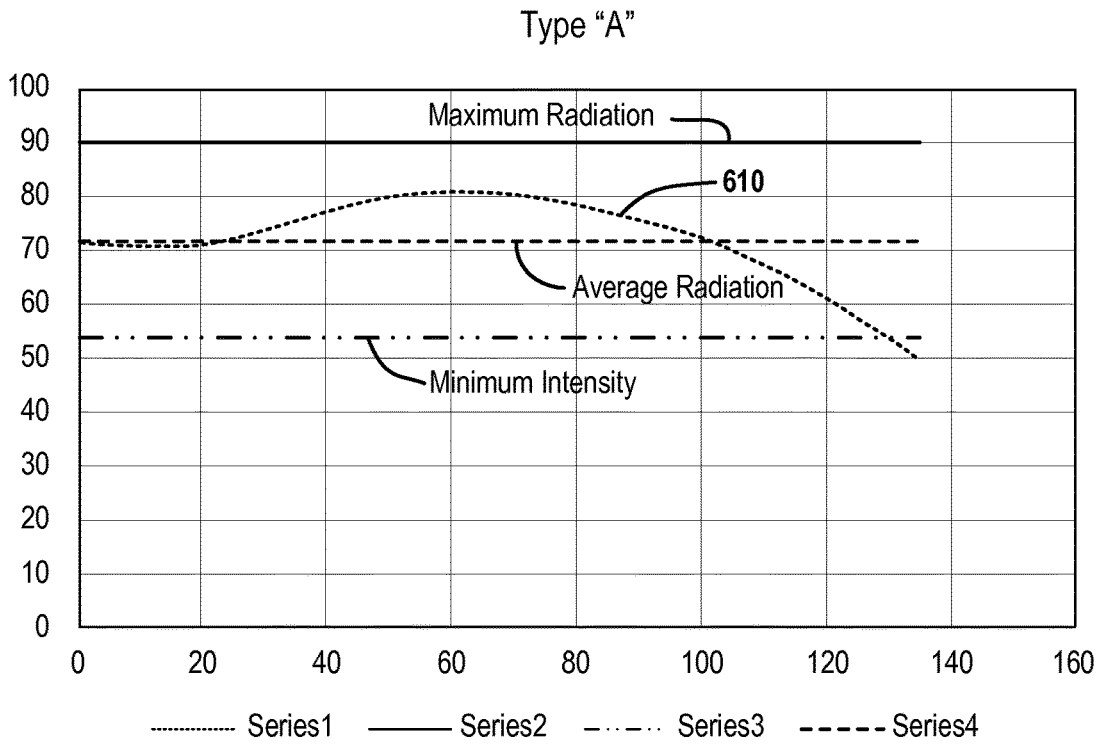
FIG. 6 is a graph of the average intensity relative to a maximum intensity and a minimum intensity around the polar axis of a light bulb.

Referring now to FIG. 6, a plot of light output showing the maximum radiation intensity, the minimum radiation intensity and the average intensity is set forth. The radiation intensities are set forth relative to the angles from the longitudinal or polar axis. The output of the light having internal redirection element set forth in FIGS. 3A-5 have the radiation intensity 610. The maximum radiation and the minimum radiation intensity correspond to the amount allowed by the standard illustrated in FIG. 1.

Figure 7A:
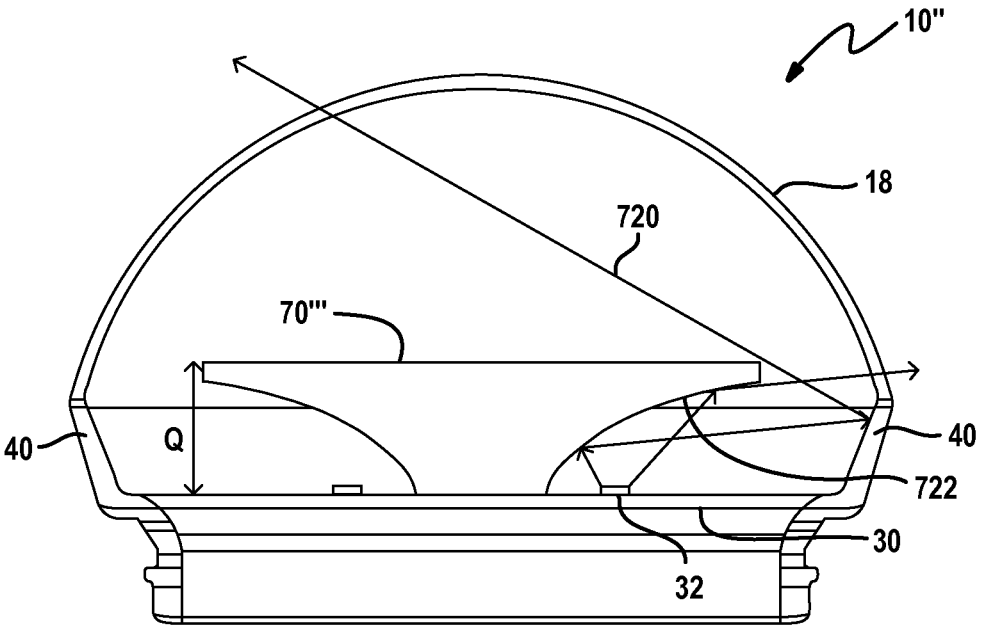
FIG. 7A is a side view of a second example of the internal redirection element having light rays disposed therein.

Referring now to FIG. 7A, another example of a light assembly 10'" is illustrated. In this example, the internal redirection element 70'" is illustrated having a taller or a greater distance Q from the circuit board 30.

Light ray 720 reflects from the redirection element 70 toward the redirection portion 40 to the center of the light assembly 10". Light 722 reflects from the redirection element 70'" and exits the cover 18 from the light source.

Figure 7B:
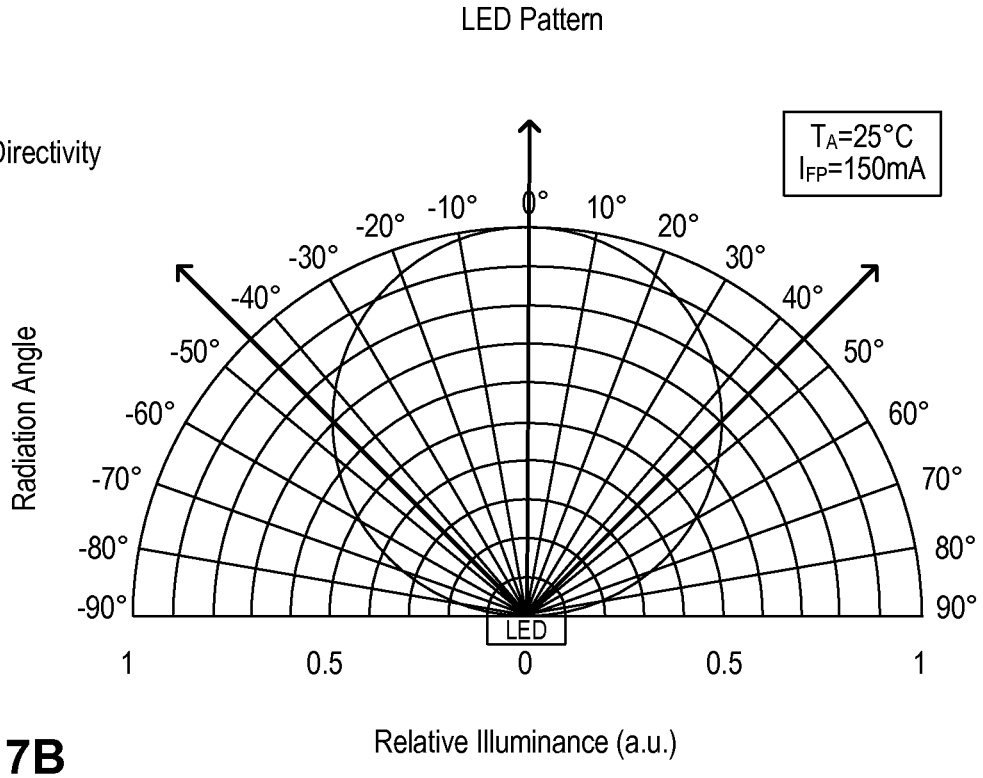
FIG. 7B is a graph of relevant illuminance versus the radiation angle.

Referring now to FIG. 7B, an illuminance pattern illustrates the relative illuminance based upon the radiation direction.

Figure 8:
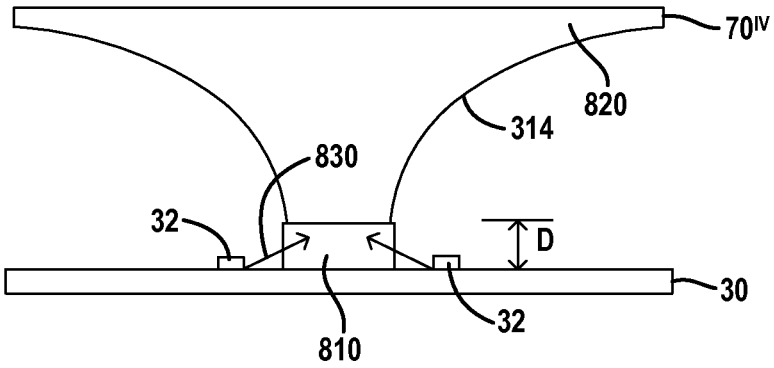
FIG. 8 is a side view of a second example of an internal redirection element.

Referring now to FIG. 8, another example of the internal redirection element $\mathbf{70}^{IV}$ is illustrated. In FIG. 8, a transparent portion 810 is illustrated relative to the translucent portion 820 of an internal redirection element $\mathbf{70}^{IV}$. A light source 32 having rays 830 directs light through the transparent portion 810. The transparent portion 810 extends a distance D above or from the surface of the circuit board 30. The distance D can be controlled to allow or shift the illuminance pattern of the light assembly. The portion of light entering the transparent portion 810 is thus not reflected by the surface 314.

It should be noted that the transmitting portion 810 may be formed together with the translucent portion 820 in a two-step or two-shot molding process.

Figure 9:
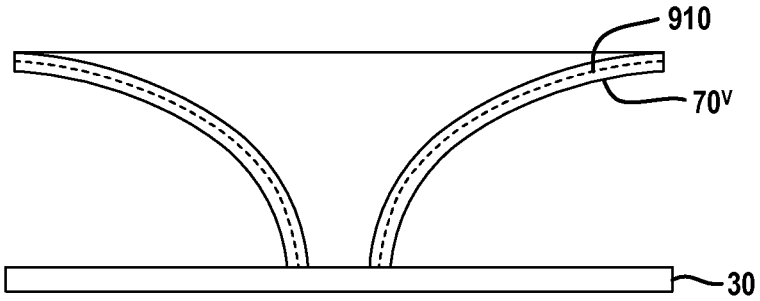
FIG. 9 is side view of a third example of an internal redirection element.

Referring now to FIG. 9, another example of the internal redirection element $\mathbf{70}^{V}$ is illustrated. In this example, light shifting elements 710 may be inserted on or within the internal redirection element $\mathbf{70}^{V}$. Light shifting or redirecting elements 910 may include nanoparticles or a mesh screen that is over molded to form the internal redirection element $\mathbf{70}^{V}$. The material of element 910 may be adjusted to provide the appropriate wavelength shifting or reflectivity of the material. The material of element 910 allows the reflectivity and transmissivity of the internal redirection element to be changed as well as the scattering caused by the internal redirection element $\mathbf{70}^{V}$.

Figure 10:
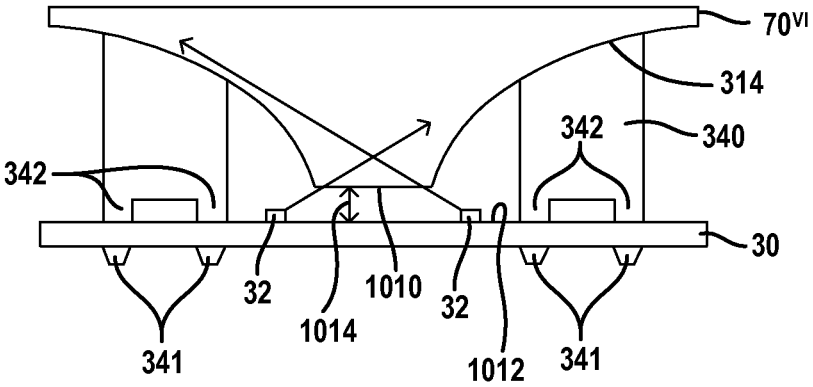
FIG. 10 is a side view of a fourth example of an internal redirection element.

Referring now to FIG. 10, another example of an internal redirection element $\mathbf{70}^{VI}$ is set forth. In this example, a center portion 1010 of the internal redirection element $\mathbf{70}^{VI}$ does not extend to annular surface 1012 of the circuit board 30. This leaves a region or gap 1014 where the light source 32 is not reflected by the surface 314. This is similar to the example illustrated in FIG. 8 above with the transparent portion 810 removed. The gap 1014 may correspond to the distance d in FIG. 8. In this example, the supports 340 support the internal redirection element $\mathbf{70}^{VI}$ over the circuit board 30. The support tabs 342 may extend through the circuit board 30. Heat staking or adhesives are options for securing the element $\mathbf{70}^{VI}$ to the circuit board 30.

Figure 11:
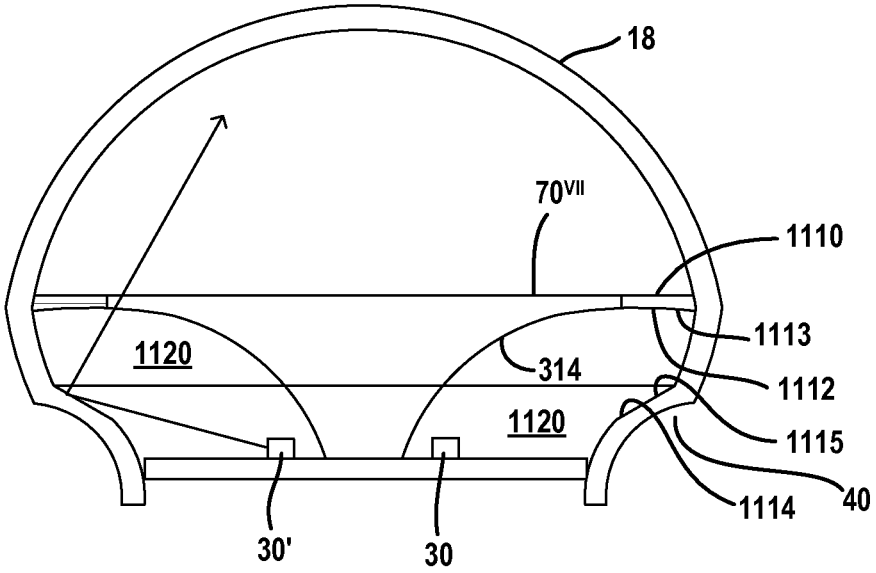
FIG. 11 is a side view of a fifth example of an internal redirection element and light windows within a cover.

Referring now to FIG. 11, another example of an internal reflection element $\mathbf{70}^{VII}$ is set forth. The internal redirection element $\mathbf{70}^{VII}$ may have an extension window 1110. The extension window 1110 may extend toward the cover 18. The window 1110 may be formed of the same material as the internal redirection element 70. That is, the window 1110 may be translucent. The window 1110 may also be transparent. In one example, the light sources 32 may be of a particular wavelength such as blue or ultraviolet. A coating 1113 may be disposed on the surface 314 and surface 1112 of the window 1110. Likewise, a coating 1115 may be disposed on a surface 1114 of the redirection surface. The coatings 1113, 1115 may be light shifting or wavelength shifting. Wavelength shifting may allow an inexpensive light source, such as a blue light emitting diode, to be used. The wavelength of the emitted light will change after interaction with the coating. The coating may be applied to all the surface or may be applied to all the surfaces except for the window 1110. Having some light in a particular spectrum emitted from the light source may be valuable. In the example of FIG. 11, a light cavity is formed around the internal redirection element $\mathbf{70}^{VII}$. The cavity 1120 extends annularly around the internal redirection element $\mathbf{70}^{VII}$ As can be seen, the amount of light for up lighting and down lighting may be controlled using modified versions of the internal redirection element. By using the various examples, the amount of redirected light can be controlled to achieve a desired performance. The ratio of the luminance of a middle portion $L_{middle}$ of the light illustrated in FIG. 2A versus the luminance of the edge portion $L_{edge}$ of the light may be less or equal to one third (⅓). This may vary by as much as luminance being of the middle to the edge to being one fifth (⅕). By using one third (⅓), the guidelines set forth in FIG. 1 may be met. Further, by providing color controllable coating on the internal redirection elements $\mathbf{70}$-$\mathbf{70}^{VIi}$, the inside of the cover 18 or other components, a desired wavelength output may be achieved.

The foregoing description of the examples has been provided for purposes of illustration and description. It is not intended to be exhaustive or to limit the invention. Individual elements or features of a particular example are generally not limited to that particular example, but, where applicable, are interchangeable and can be used in a selected example, even if not specifically shown or described. The same may also be varied in many ways. Such variations are not to be regarded as a departure from the invention, and all such modifications are intended to be included within the scope of the invention.

What is claimed is:

1. A light assembly comprising:

a cover having an upper portion and a redirection portion, said cover having a longitudinal axis and an interior;

a housing coupled to the cover;

a lamp base coupled to the housing;

a circuit board disposed within the housing, said circuit board having a plurality of light sources thereon; and an internal redirection element coupled to the circuit board having a curvilinear shaped surface for reflecting a first portion of light from the plurality of light sources toward the redirection portion of the cover and transmitting a second portion of light through the internal redirection element, wherein at least a first part of the first portion of light is reflected from the redirection portion of the cover and is reflected to the interior of the cover and then through the cover.

2. The light assembly as recited in claim 1 wherein a second part of the first portion of light is directed out of the light assembly through the redirection portion.

3. The light assembly as recited in claim 1 wherein the curvilinear shaped surface comprises a conic cross section.

4. The light assembly as recited in claim 1 wherein the curvilinear shaped surface comprises a conic cross section rotated about the longitudinal axis.

5. The light assembly as recited in claim 4 wherein the conic cross section comprises a partial paraboloid.

6. The light assembly as recited in claim 4 wherein the conic cross section comprises a partial ellipsoid.

7. The light assembly as recited in claim 4 wherein the conic cross section comprises a partial spheroid.

8. The light assembly as recited in claim 4 wherein the conic cross section comprises a partial hyperboloid.

9. The light assembly as recited in claim 1 wherein the curvilinear shaped surface comprises a conic cross section having an axis disposed at an angle relative to a surface of the circuit board, said conic cross section is rotated about the longitudinal axis of the light assembly.

10. The light assembly as recited in claim 1 wherein the curvilinear shaped surface comprises a conic cross section having an axis disposed at an angle relative to a surface of the circuit board by a predetermined angle, said conic cross section is rotated about the longitudinal axis of the light assembly.

11. The light assembly as recited in claim 10 wherein the axis intersects a ring comprising the plurality of light sources.

12. The light assembly as recited in claim 11 wherein the ring is a focal line for the redirection portion of the cover.

13. The light assembly as recited in claim 12 wherein the redirection portion of the cover comprises a partial ellipsoid.

14. A light assembly comprising:

a cover having an upper portion and a redirection portion, said cover having a longitudinal axis;

a housing coupled to the cover;

a lamp base coupled to the housing;

a circuit board disposed within the housing, said circuit board having a plurality of light sources thereon; and an internal redirection element coupled to the circuit board having a curvilinear shaped surface for reflecting a first portion of light from the plurality of light sources toward the redirection portion of the cover and transmitting a second portion of light through the internal redirection element, wherein the internal redirection element comprises a transparent portion.

15. A light assembly comprising:

a cover having an upper portion and a redirection portion, said cover having a longitudinal axis;

a housing coupled to the cover;

a lamp base coupled to the housing;

a circuit board disposed within the housing, said circuit board having a plurality of light sources thereon; and an internal redirection element coupled to the circuit board having a curvilinear shaped surface for reflecting a first portion of light from the plurality of light sources toward the redirection portion of the cover and transmitting a second portion of light through the internal redirection element, wherein the internal redirection element comprises a gap between the circuit board and a plurality of supports coupling the internal redirection element to the circuit board.

* * * * *